US006679532B2

(12) United States Patent
Inoue

(10) Patent No.: US 6,679,532 B2
(45) Date of Patent: Jan. 20, 2004

(54) VEHICLE DOOR LATCH DEVICE

(75) Inventor: Jiro Inoue, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,199

(22) Filed: Nov. 13, 2001

(65) Prior Publication Data

US 2002/0074808 A1 Jun. 20, 2002

(30) Foreign Application Priority Data

Nov. 13, 2000 (JP) ..... 2000-344578

(51) Int. Cl.[7] ..... E05C 3/06

(52) U.S. Cl. ..... 292/216; 292/201; 292/DIG. 23; 292/DIG. 64

(58) Field of Search ..... 292/216, DIG. 23, 292/DIG. 64, 201

(56) References Cited

U.S. PATENT DOCUMENTS 3,781,045 A * 12/1973 Watermann ..... 292/216
3,923,329 A * 12/1975 Torii et al. ..... 292/216
4,538,845 A * 9/1985 Yamada ..... 292/216
4,904,006 A * 2/1990 Hayakawa et al. ..... 292/336.3
4,948,183 A * 8/1990 Yamada ..... 292/199
4,978,154 A * 12/1990 Kleefeldt et al. ..... 292/201
5,064,229 A * 11/1991 Hamada et al. ..... 292/216
5,100,185 A * 3/1992 Menke et al. ..... 292/216
5,603,539 A * 2/1997 Gruhn et al. ..... 292/216
5,634,677 A * 6/1997 Büscher et al. ..... 292/216
5,639,130 A * 6/1997 Rogers et al. ..... 292/216
5,667,263 A * 9/1997 Kleefeldt et al. ..... 292/336.3
5,678,869 A * 10/1997 Yoshikuwa ..... 292/216
5,996,381 A * 12/1999 Yoneyama ..... 70/237
6,059,328 A 5/2000 Gomi
6,102,453 A * 8/2000 Cetnar ..... 292/201

FOREIGN PATENT DOCUMENTS

GB 2 357 548 A 6/2001

* cited by examiner

*Primary Examiner*—J. J. Swann
*Assistant Examiner*—Carlos Lugo
(74) *Attorney, Agent, or Firm*—Browdy and Neimark

(57) ABSTRACT

A vehicle door latch device comprises a pawl lever keeping engagement between a latch and a striker, an output member rotatable in an unlocking direction and in a locking direction by power of a motor and being restored to a neutral position by elasticity of a returning spring when the motor is turned off, a lock lever displaceable between an unlocked position and a locked position by directly receiving rotational movement of the output member, an open link switched between an operative position and a non-operative position by displacement of the lock lever. The open link is directly connected to the lock lever by way of no movable member.

4 Claims, 8 Drawing Sheets

VEHICLE DOOR LATCH DEVICE

BACKGROUND OF THE INVENTION

1. Field of the Invention

The present invention relates to a vehicle door latch device.

2. Description of the Prior Art

FIG. 10 shows a lock mechanism and an opening mechanism of a conventional typical vehicle door latch device (for example U.S. Pat. No. 4,905,532). The prior art latch device comprises a lock lever A for connection to an inside lock button B, an open link C actuated by an open handle D, and a pawl lever E releasing engagement between a latch and a striker. The lock lever A in FIG. 10 is in the unlocked position, and when the open link C is moved down by the actuation of the open handle D, a pressing part F of the open link C comes into contact with a contact part G of the pawl lever E to rotate the pawl lever E, and the door is opened.

FIG. 11 shows an prior art actuator unit which moves the lock lever A to the locked position and the unlocked position. The actuator unit comprises a motor H, an output member or a worm wheel J rotated by the motor H, and an intermediate lever K rotated by the contact with the worm wheel J, and the lock lever A is connected to a rotary shaft L of the intermediate lever K. The worm wheel J returns to the neutral position when the motor H is turned off.

A first problem of the prior art device is caused by the fact that the rotational movement of the worm wheel J is transmitted to the open link C through two members, that is, the intermediate lever K and the lock lever A. If the intermediate lever K and the lock lever A can be constructed by one member, the door latch device can be simplified.

A second problem of the prior art device is caused by the fact that the lock lever A and the open link C occupy a wide range in the rear surface of a latch housing M. The lock lever A and the open link C positioned at the central portion of the rear surface make the latch device thick in the back-and-forth direction, and often causes the interference with the window glass. Furthermore, the lock lever A and the open link C positioned on the exterior side of the housing M easily receive an illegal access by using a tool which is inserted into the clearance between the window frame and the window glass of the door.

A third problem of the conventional device is caused by the fact that the lock lever A and the open link C are exposed on the outside of the housing M. The exposed lock lever A and open link C easily receive the illegal access from the outside.

Furthermore, U.S. Pat. No. 6,059,328 describes a door latch device which comprises a metal base plate (18) having a main plate (18A) in the left-and-right direction and a sub plate (18B) bent backward from the interior side portion of the main plate, a latch (3) engageable with a striker (2), a pawl lever (4) keeping engagement between the latch and the striker by being engaged with the latch, a synthetic resin striker guide (5) arranged on the rear side of the main plate and having a striker passage (17), and a metal mounting plate (21) having a rear keeping plate which comes into contact with the rear surface of the striker guide. The mounting plate (21) has a backward bent contact plate (21B) at the interior side portion thereof. An actuator (22) is fixed between the contact plate (21B) and the sub plate (18B).

A problem of this prior art device is caused by the fact that the contact plate (21B) does not so much contribute to the improvement of rigidity of the latch device. The strong external force caused by a vehicle accident or the like concentrically acts on the engaged part of the latch and the striker to move the contact plate (21B) of the mounting plate (21) toward the interior side sometimes. The moving force of the contact plate (21B) is transferred to the sub plate (18B) through the actuator, but the actuator is positioned at a lower position far from the striker passage (17), and therefore, the external force which is concentrated to the engaged part in the striker passage (17) cannot well be absorbed.

Furthermore, the striker guide (5) also has such a problem that it is large and heavy since it entirely contains the latch and the pawl lever.

SUMMARY OF THE INVENTION

Accordingly, it is an object of the present invention to provide a door latch device having an improved lock lever which functions also as an intermediate lever. The improved lock lever simplifies the door latch device.

Furthermore, it is another object of the present invention to provide a door latch device having a lock lever and an open link arranged on the interior side of the latch device, where it is difficult to be illegally accessed from the outside.

Furthermore, it is another object of the present invention to provide a door latch device, in which a lock lever and an open link to be displaced by power of a motor are contained in a housing for shutting off an illegal access from the outside.

Furthermore, it is another object of the present invention to provide a door latch device capable of well absorbing the external force which concentrically acts on the engaged part of the latch and the striker because of a vehicle accident or the like.

Furthermore, it is another object of the present invention to provide a door latch device having a striker guide which is small and light, and can be manufactured at a low cost.

DETAILED DESCRIPTION OF THE PREFERRED EMBODIMENT

Figure 1:
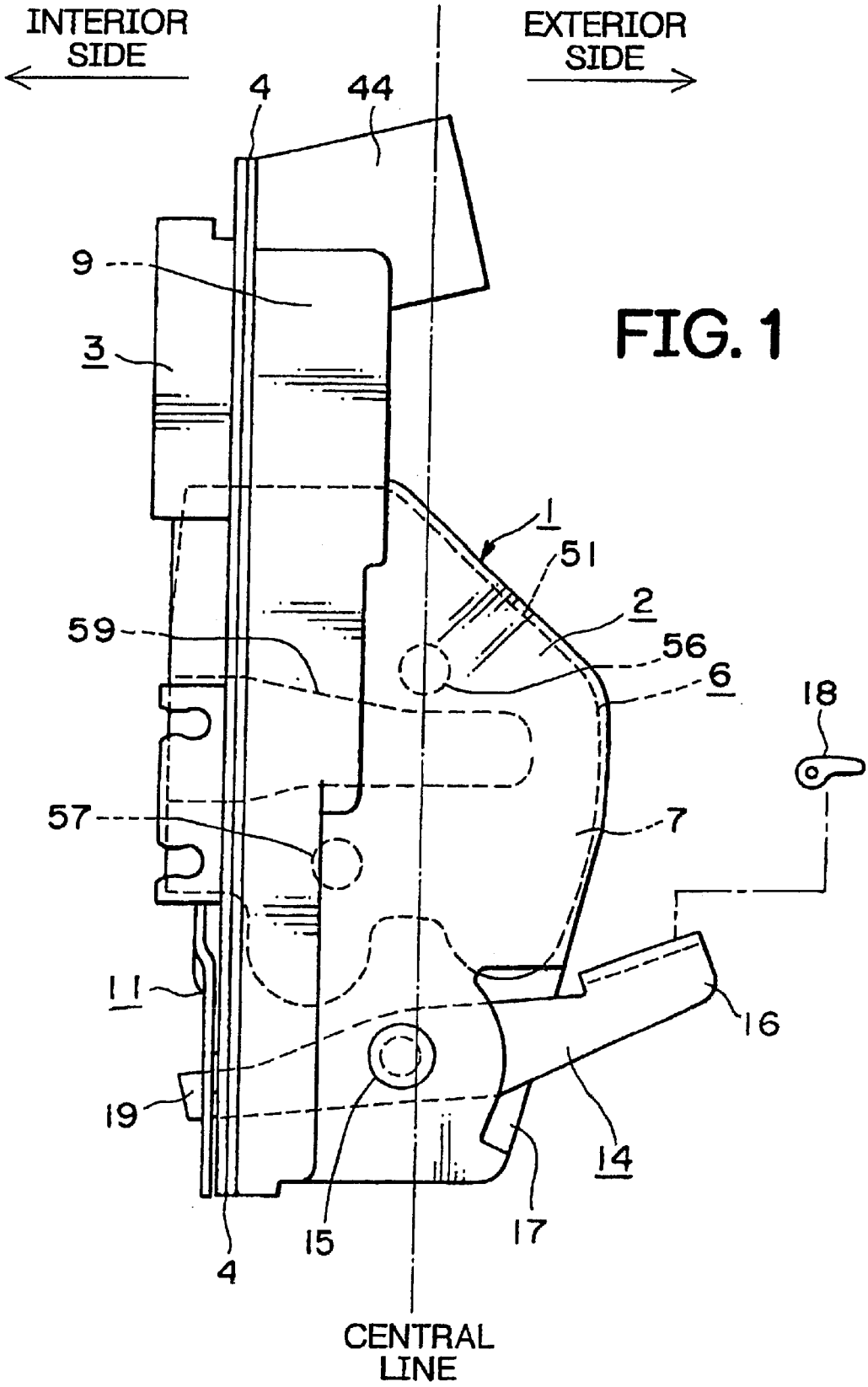
FIG. 1 is a rear view of a door latch device according to the present invention.
Figure 2:
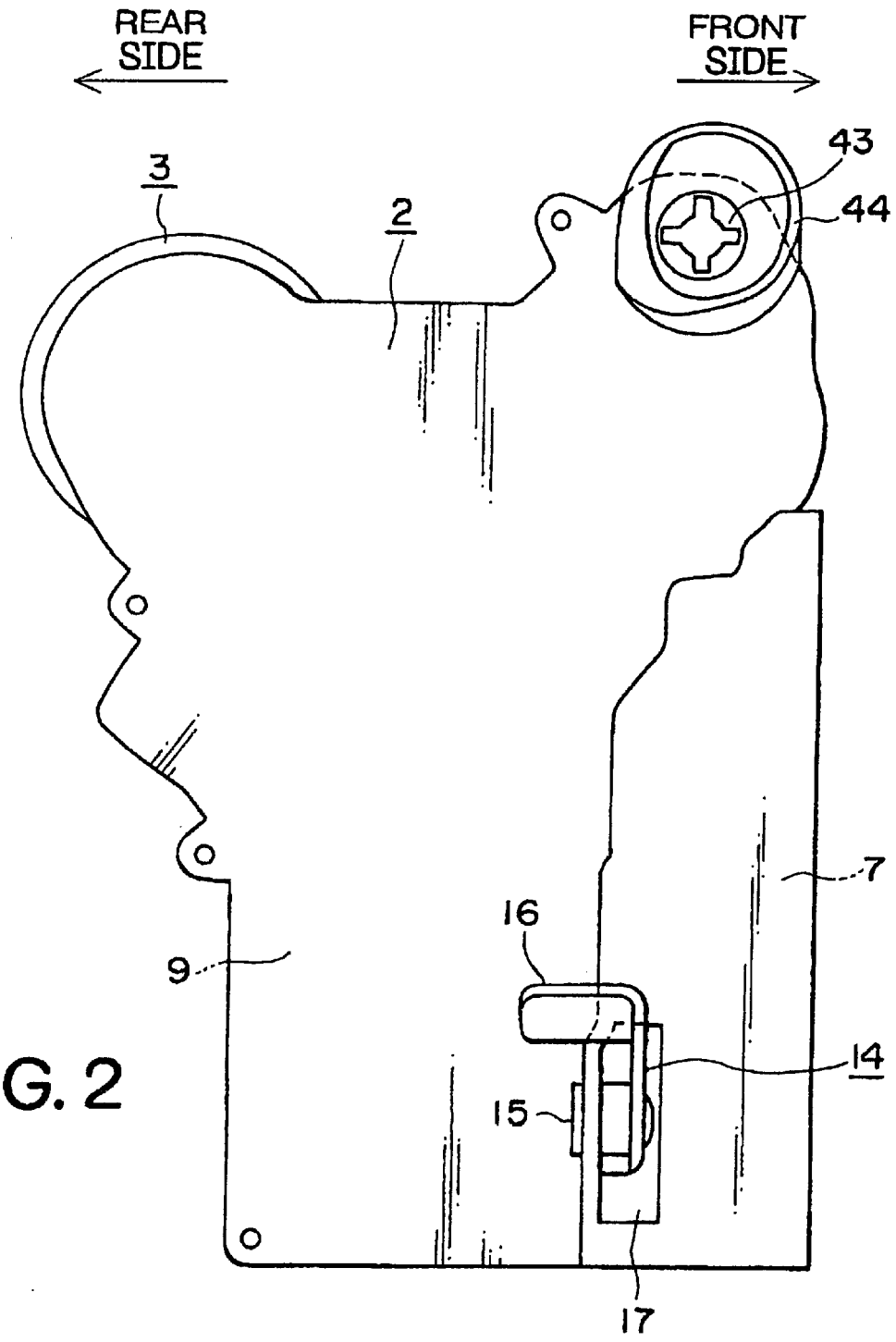
FIG. 2 is a side view showing an exterior side of the door latch device.

FIG. 1 shows the rear side of the door latch device according to the present invention. A synthetic resin housing 1 of the door latch device comprises a main case 2 facing to the exterior side of a vehicle door and a sub case 3 facing to the interior side of the door. The main case 2 and the sub case 3 are connected and fixed to each other by a screw 5 or the like at a connecting surface 4. The interior side and exterior side directions shown in the figure are in parallel with the thickness direction of the door which is, hereafter, often referred to as the left-and-right direction.

Figure 4:
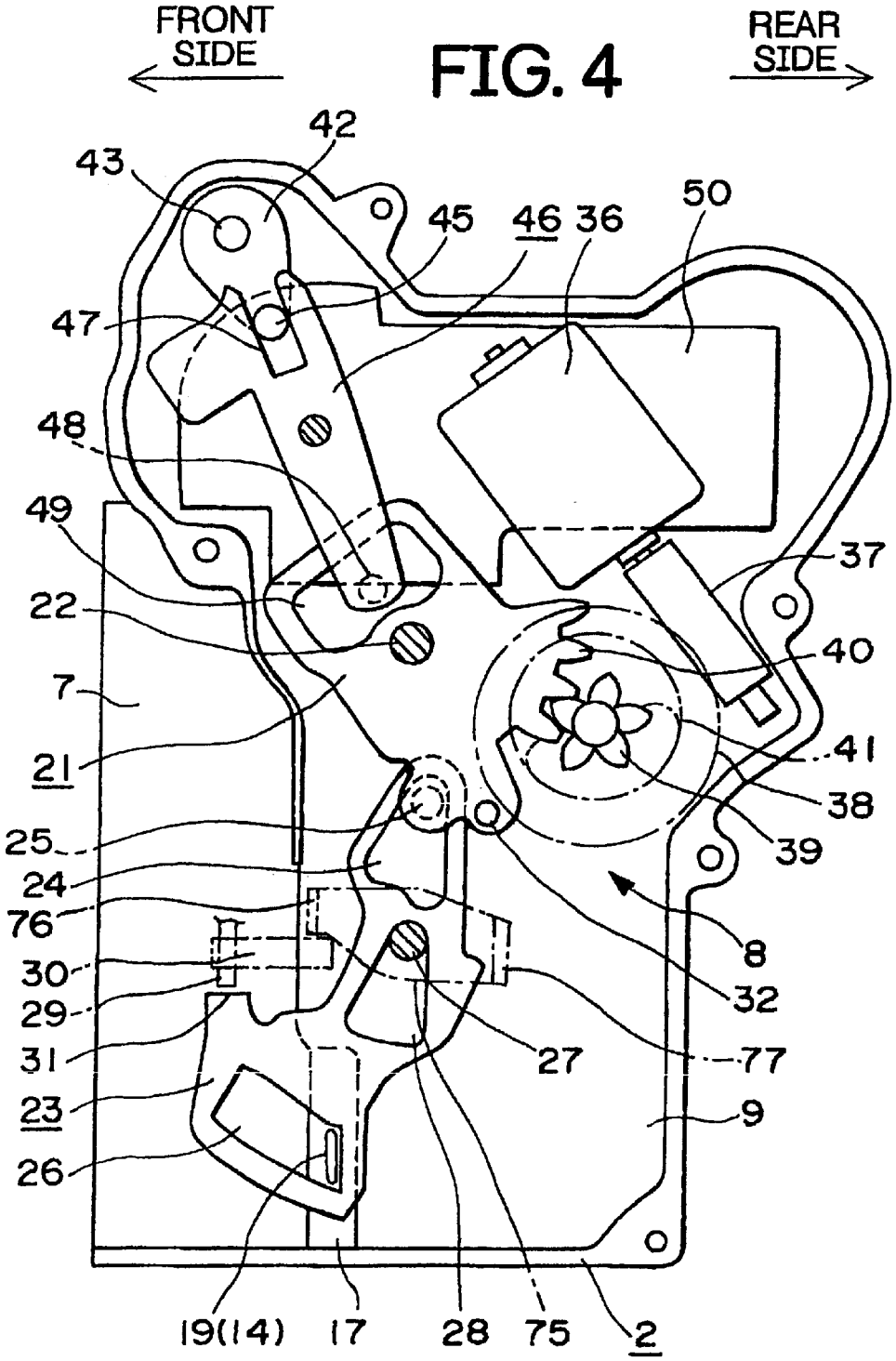
FIG. 4 is a side view showing the state where a sub case is removed from the door latch device in FIG. 3.

The substantially L-shaped main case 2 has a first space 7 extending in the left-and-right direction and a second space 9 extending in the back-and-forth direction. The first space 7 contains a latch unit 6 (FIG. 5), and the second space 9 contains a plurality of members such as a lock mechanism 8. The second space 9 is positioned on the interior side of the latch device with respect to the vertical central line, in FIG. 1. The interior side of the first space 7 communicates with the front side of the second space 9, as shown in FIG. 4. The sub case 3 is shaped like a plate or board extending in the back-and-forth direction, and is attached to the interior side surface of the main case 2 as a cover. The front side of the main case 2 is substantially covered by a base plate 51 of the latch unit 6.

Figure 3:
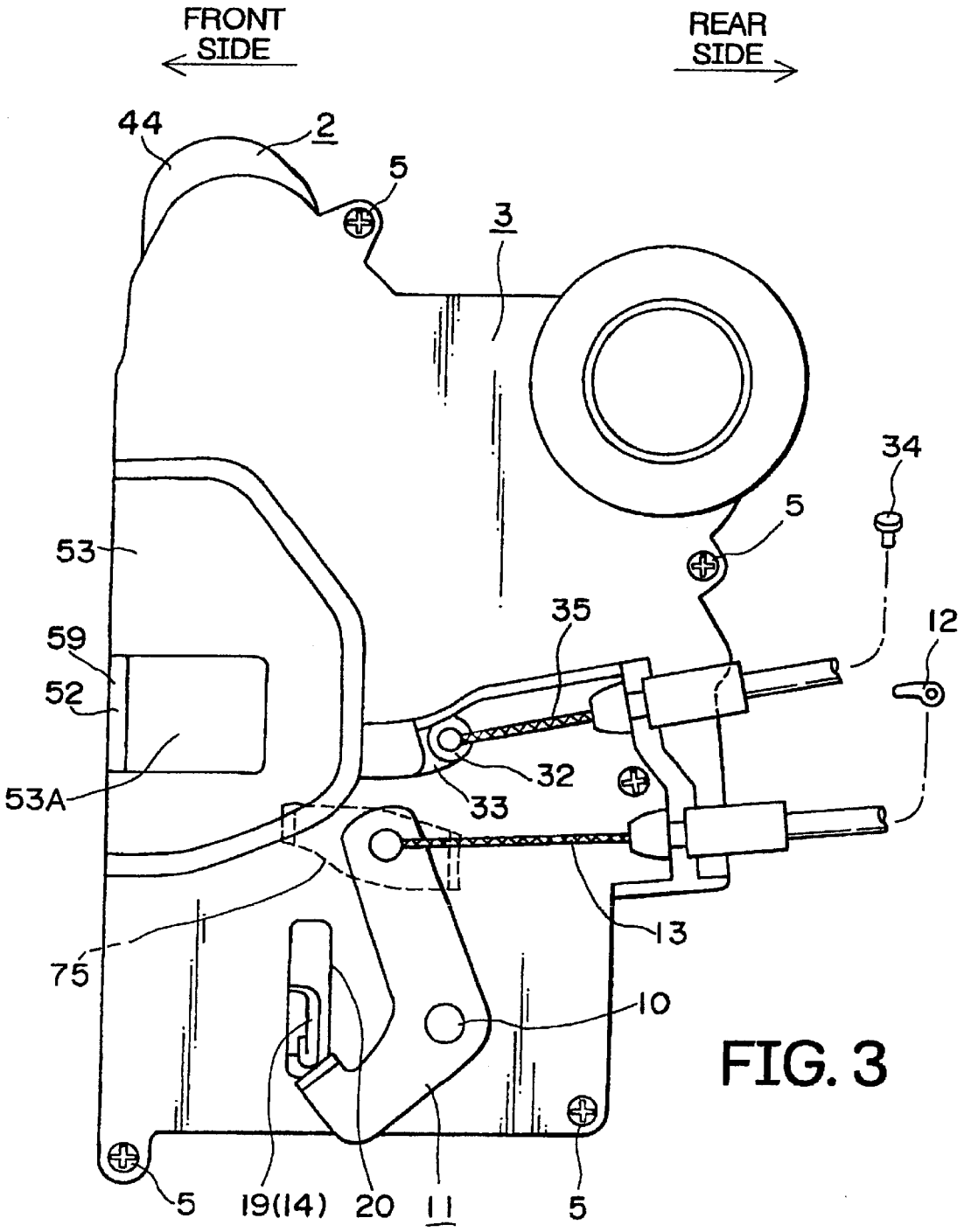
FIG. 3 is a side view showing an interior side of the door latch device.

To the outer surface of the sub case 3, as shown in FIG. 3, an inner lever 11 is pivoted by a shaft 10 extending in the left-and-right direction. One end of the inner lever 11 is connected to an inside open handle 12 of the door through a wire 13. As shown in FIG. 1, to the inside (front side) of the rear wall of the first space 7, an open lever 14 is pivoted by a lever shaft 15 extending in the back-and-forth direction. The exterior side portion 16 of the open lever 14 is projected to the outside of the housing 1 through an opening 17 of the main case 2, and is operatively connected to an outside open handle 18 of the door. The interior side portion 19 of the open lever 14 is projected to the outside of the housing 1 through an opening 20 of the sub case 3, and is engageably opposed to the tip end of the inner lever 11.

As shown in FIG. 4, in the second space 9, a plurality of members such as the lock mechanism 8 is contained. A lock lever 21 of the lock mechanism 8 is rotatably supported by a lock shaft 22 extending in the left-and-right direction which is integrally formed to the main case 2. The lock lever 21 is turned around the lock shaft 22 to be displaced between well known locked and unlocked positions. The lock lever 21 shown in FIG. 4 is positioned in the unlocked position. The lock lever 21 has a projection 25 which is slidably engaged with a triangle-like connecting hole 24 formed in the upper part of an open link 23. The open link 23 has, at the lower part thereof, an engaging hole 26 with which the interior side portion 19 of the open lever 14 is engaged. The open link 23 has a triangle-like central hole 28 at the middle portion thereof. A guide shaft 27 in the left-and-right direction formed integrally with the main case 2 is slidably engaged with the central hole 28. The open link 23 substantially is turned around the guide shaft 27 by the displacement of the lock lever 21. The open link 23 moves up by being guided with the projection 25 and the guide shaft 27 when the open lever 14 is rotated in the door opening direction.

In the first space 7, the latch unit 6 is contained, but in FIG. 4, only a pawl lever 29 and a pawl pin 30 of the latch unit 6 are shown by imaginary lines. The pawl lever 29 releases the latch unit 6 so as to open the door when rotated, which is described later.

The lock lever 21 shown in FIG. 4 is positioned at the unlocked position. In the unlocked state, a contact edge 31 of the open link 23 is engageably opposed to the pawl lever 29 so that the contact edge 31 of the open link 23 rotates the pawl lever 29 to open the door when the open link 23 is moved up by opening rotation of the open lever 14. When the lock lever 21 is displaced to the locked position, the open link 23 is rotated counterclockwise, and the contact edge 31 is separated from the pawl lever 29. Accordingly, in the locked state, even if the open link 23 is moved up, the pawl lever 29 does not rotate, and the door is not opened.

The lock lever 21 integrally has a connecting part 32 which is exposed to the outside through a window hole 33 of the sub case 3, as shown in FIG. 3, and the connecting part 32 is connected, through the window hole 33, to a wire 35 which leads to an inside lock button 34 of the door.

A motor 36 is contained in the upper part of the second space 9. The rotary shaft of the motor 36 supports a cylindrical worm 37 with which a worm wheel 38 is meshed. A gear wheel 39 having five gear teeth is fixed to the rotary shaft of the worm wheel 38, and is meshed with a geared portion 40 formed in the lock lever 21. The worm wheel 38 is kept at the neutral position by the elasticity of a returning spring 41 when the motor 36 is not energized, and it can be rotated both in the counterclockwise (locking) direction and in the clockwise (unlocking) direction from the neutral position by the power of the motor 36. The structure from the motor 36 to the geared portion 40 is described in detail in GB 2,357,548 A, and therefore, here, it will simply be described below. In the state of FIG. 4, when the gear wheel 39 rotates counterclockwise, the lock lever 21 is rotated clockwise to be displaced from the unlocked position to the locked position, and after that, even if the worm wheel 38 is rotated clockwise by the elasticity of the returning spring 41 to be returned to the neutral position, the lock lever 21 is kept at the locked position as it is. When the worm wheel 38 rotates clockwise from the neutral position by the motor power, the lock lever 21 is restored from the locked position to the unlocked position, and after that, even if the worm wheel 38 is rotated counterclockwise by the elasticity of the returning spring 41 to be returned to the neutral position, the lock lever 21 is kept at the unlocked position as it is. Furthermore, when the worm wheel 38 is positioned at the neutral position, the rotation of the lock lever 21 is not transferred to the geared portion 39.

Figure 10:
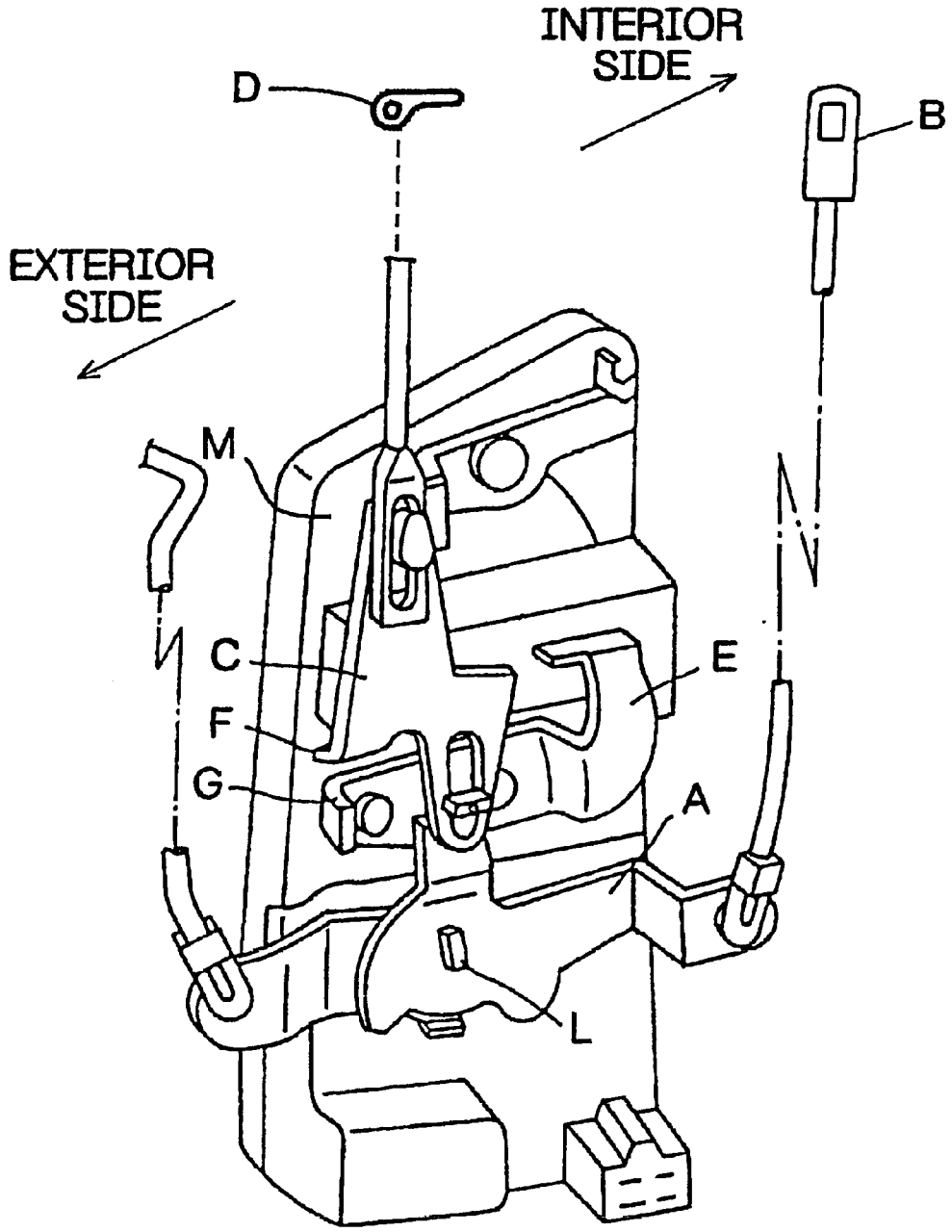
FIG. 10 (PRIOR ART)
FIG. 10 is a perspective illustration of a prior art door latch device.
Figure 11:
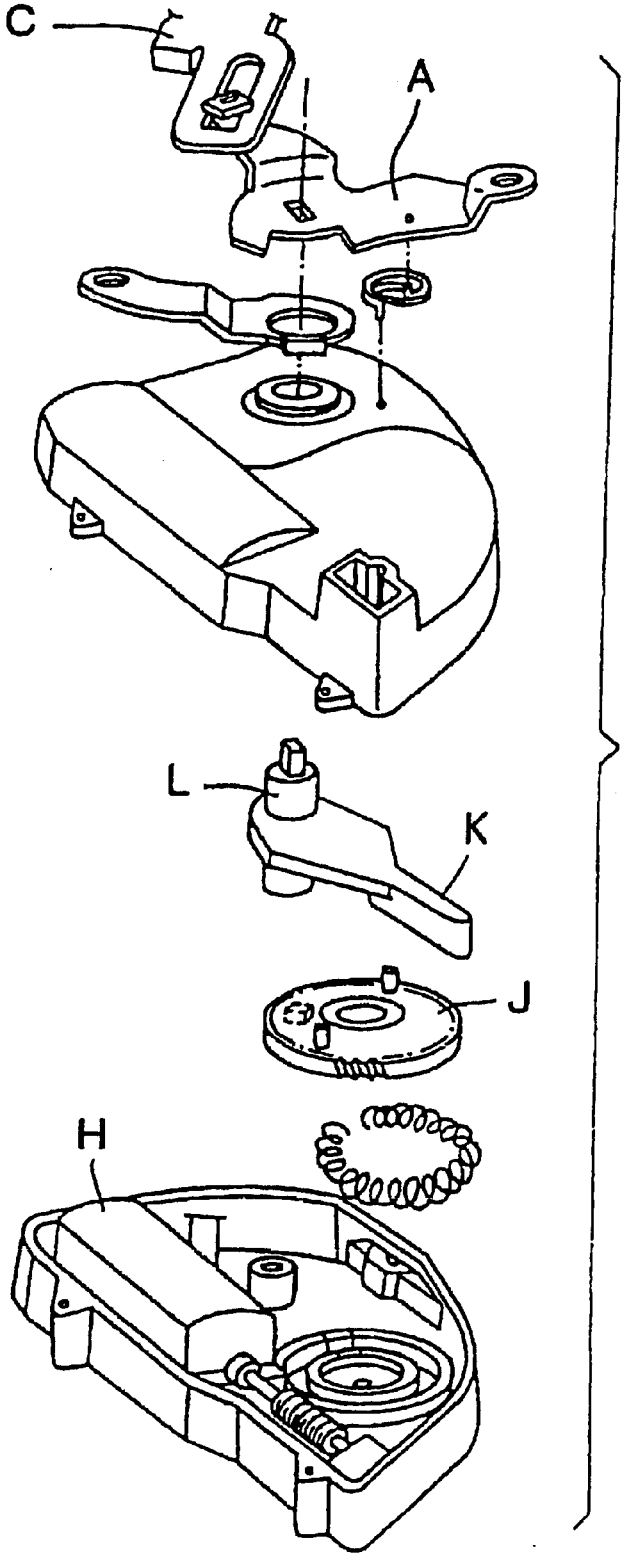
FIG. 11 (PRIOR ART)
FIG. 11 is an exploded perspective illustration of the prior art door latch device.

The lock lever 21 according to the present invention connects the worm wheel 38 (geared portion 40) and the open link 23. Here, the worm wheel 38 is defined as a member which is restored to the neutral position by the elasticity of the neutral returning spring 41 when the motor 36 is not energized. Furthermore, the open link 23 is defined as a member which can transfer the opening operational force of the open handles 12 and 18 to the pawl lever 29. The lock lever 21 of the present invention has such a characteristic, and therefore, it can serve as both the lock lever A and the intermediate member K shown in FIGS. 10 and 11.

Furthermore, it should be noted that the lock lever 21 is rotatably supported by the lock shaft 22 having an axial line in the left-and-right direction. Therefore, the lock lever 21 can easily be attached to the rearwardly extending side wall of housing 1 positioned in the interior side of the latch device, and the anti-theft performance of the lock lever 21 is improved. That is, the interior side of the door latch device has less danger of receiving an illegal access from the outside than the exterior side. Additionally, in the case of the present invention, the lock lever 21 and the open link 23 are arranged on the interior side of the door latch device, and therefore, the door latch device becomes thin in the back-and-forth direction on the central and exterior side portions. Consequently, the degree of freedom when attaching the door latch device to the door is improved.

Furthermore, the second space 9 accommodating the lock lever 21 and the open link 23 extends in the back-and-forth direction, and therefore, it can easily be surrounded by the main case 2 and the sub case 3. Therefore, the open link 23 and the lock lever 21 in the second space 9 can effectively be shut off against the illegal access from the outside. In addition, the motor 36 can also be contained in the second space 9, and therefore, the connection between the motor 36 and the lock lever 21 can easily be performed, and a third space for the motor 36 becomes unnecessary.

In FIG. 4, to the upper part of the second space 9, a key lever 42 is attached by a key shaft 43 which is exposed to the outside through a cylindrical part 44 of the main case 2 to be connected to a door key cylinder through a rod or the like. Furthermore, the door key cylinder may also be provided in the cylindrical part 44. A pin 45 provided at the end part of the key lever 42 is engaged with a forked part 47 formed at one end of a connecting lever 46. A pin 48 at the other end of the connecting lever 46 is engaged with an engaging hole 49 formed in the upper part of the lock lever 21. Reference numeral 50 denotes a printed circuit board.

Figure 5:
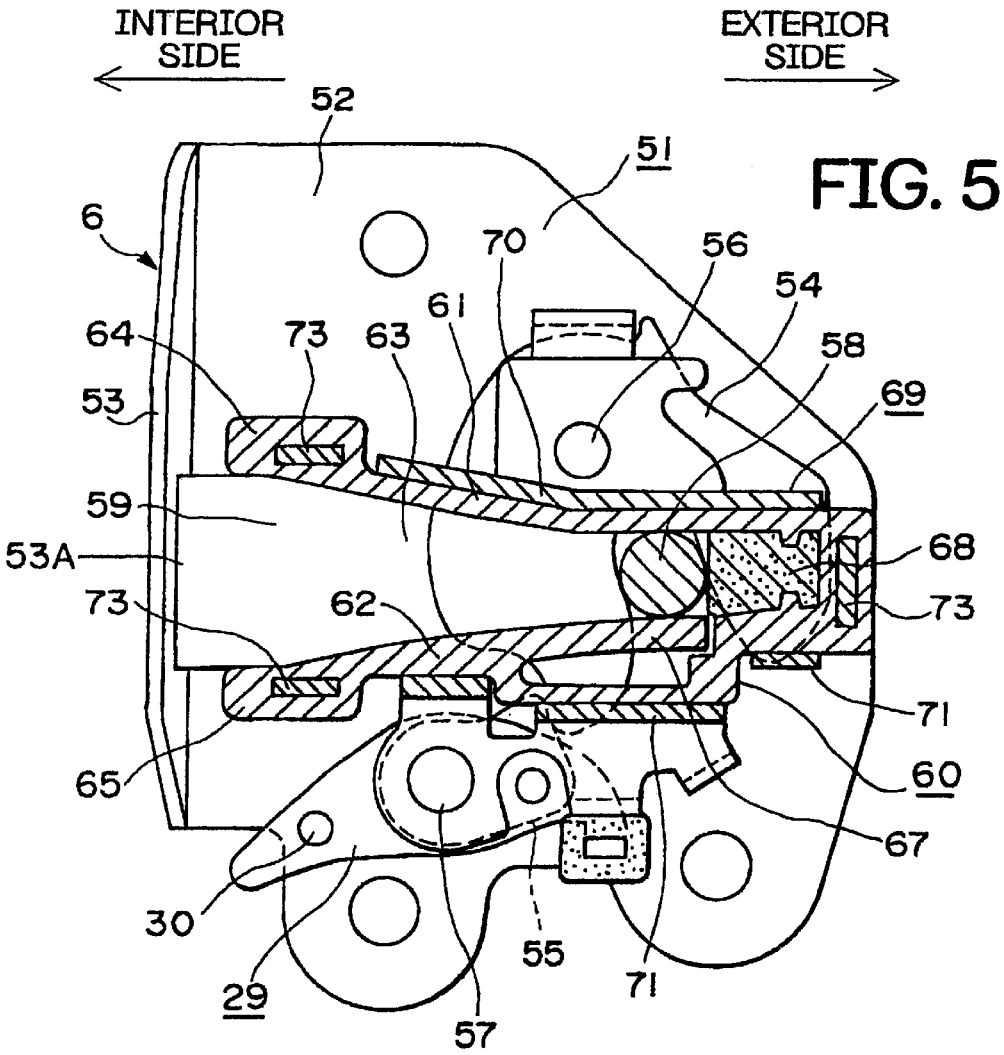
FIG. 5 is a longitudinal sectional rear view of a latch unit of the door latch device.
Figure 6:
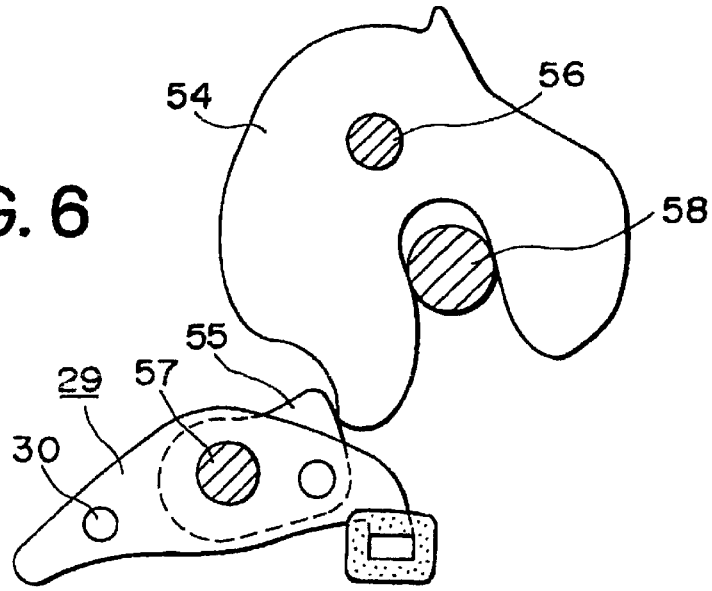
FIG. 6 is a rear view showing a latch and a pawl lever of the latch unit.
Figure 9:
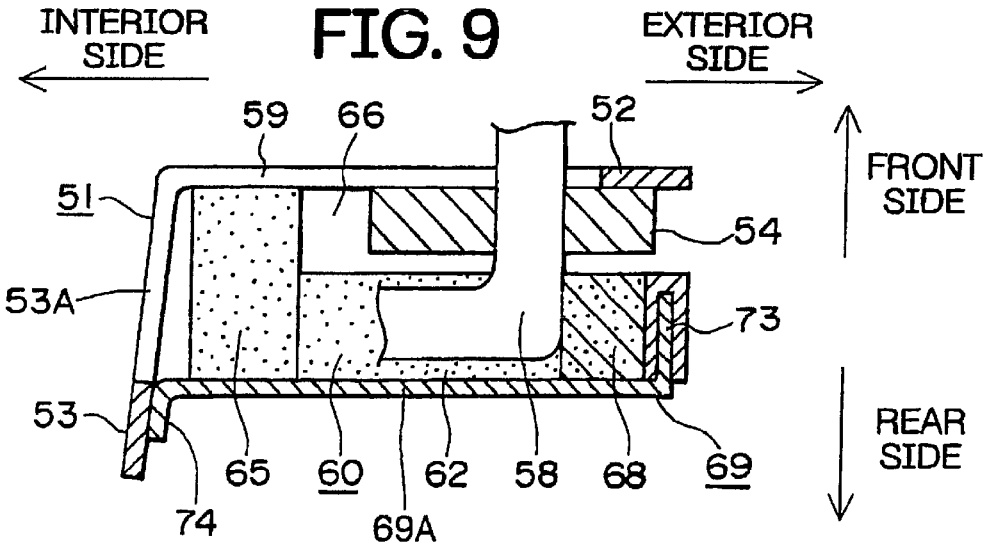
FIG. 9 is a lateral cross sectional view of the latch unit.

FIG. 5 shows the latch unit 6 to be contained in the first space 7. The metal base plate 51 of the latch unit 6 is approximately L-shaped when seen from the upper side, as shown in FIG. 9, and is constructed by a main plate 52 extending in the left-and-right direction and a sub plate 53 bent backward from the interior side portion of the main plate 52. When the latch unit 6 is contained in the first space 7, the front side opening of the first space 7 is substantially closed by the main plate 52, and the sub plate 53 is positioned approximately on the same plane as the sub case 3 to close the interior side of the first space 7.

To the rear side of the main plate 52, a well known latch mechanism having a latch 54 and the pawl lever 29 is attached. A latch shaft 56 of the latch 54 and a pawl shaft 57 of the pawl lever 29 extend in the back-and-forth direction. The sub plate 53 has a striker gate 53A in the back-and-forth direction into which a striker 58 fixed to the vehicle body enters, and the main plate 52 has a lateral U-shaped striker channel 59 communicated with the striker gate 53A. The striker 58 which enters the striker channel 59 by closing the door is engaged with the latch 54. The engagement between the latch 54 and the striker 58 is kept by the engagement of a pawl 55 of the pawl lever 29 with the latch 54.

In the latch device, the interior and exterior sides of the latch device are distinguished by the position of the striker gate 53A into which the striker 58 enters when the door is closed, which striker gate must be formed on the interior side of the latch device.

Figure 7:
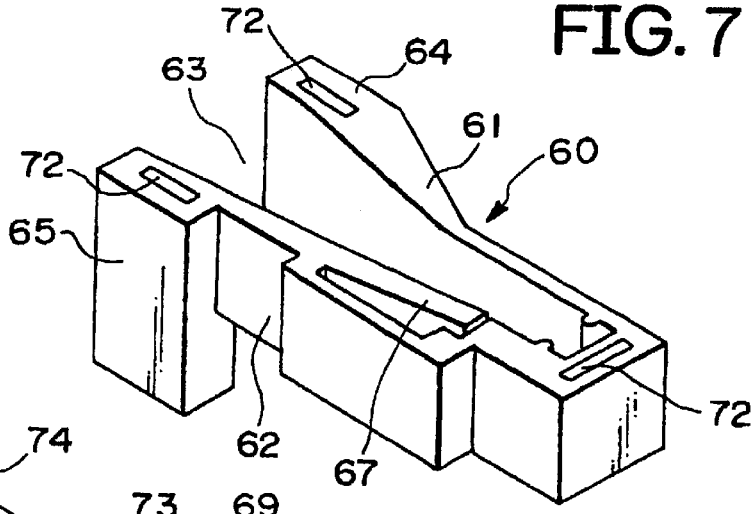
FIG. 7 is a perspective illustration of a striker guide of the latch unit.
Figure 8:
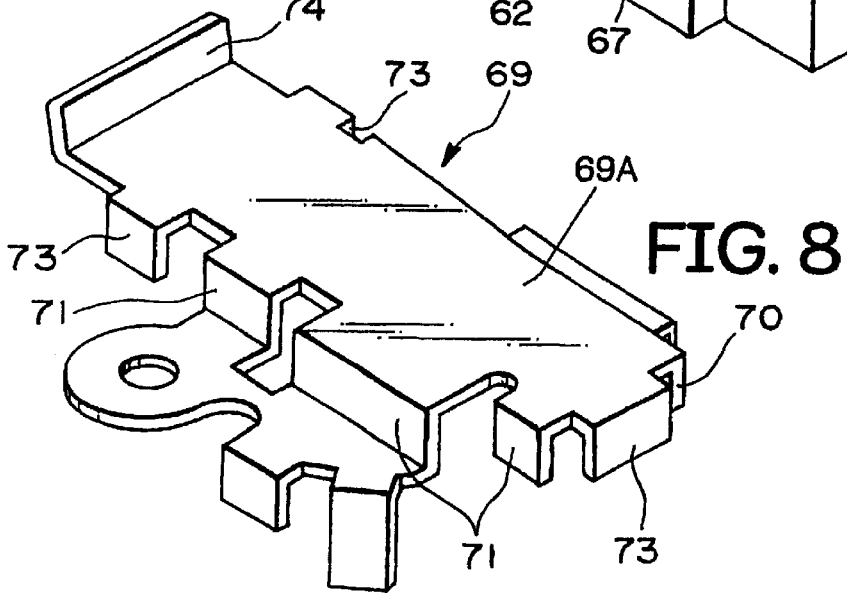
FIG. 8 is a perspective illustration of a mounting plate of the latch unit.

On the rear side of the latch mechanism, a synthetic resin striker guide 60 shown in FIG. 7 is arranged. The striker guide 60 is shaped like a lateral "U ", and has an upper wall 61 and a lower wall 62 between which a striker passage 63 having the same shape as the striker channel 59 is formed. To the interior side portion of the striker guide 60, upper and lower struts 64 and 65 which come into contact with the main plate 52 are integrally formed. The striker guide 60 does not come into contact with the main plate 52 at a part other than the struts 64 and 65, and a clearance 66 (FIG. 9) formed between the striker guide 60 and the main plate 52 accommodates the latch mechanism. The lower wall 62 integrally has an elastic part 67 which elastically comes into contact with the striker 58. To the exterior side portion of the striker passage 63, a rubber stopper 68 is attached.

The latch and pawl shafts 56 and 57 fix to the main plate 52 a metal mounting plate 69 for keeping, protecting and reinforcing the striker guide 60. The mounting plate 69 comprises a rear keeping plate 69A which covers the rear side of the striker guide 60, an upper keeping plate 70 which is angled to extend forward from upper edge of the rear keeping plate 69A so as to be overlapped onto the upper surface of the upper wall 61 of the striker guide 60, and a lower keeping plate 71 which is angled to extend forward from the lower edge of the rear keeping plate 69A so as to be overlapped onto the under surface of the lower wall 62 of the striker guide 60. The mounting plate 69 further comprises a plurality of bent legs 73 to be inserted into a plurality of engaging holes 72 formed in the striker guide 60, and the striker guide 60 is kept at a specified position by the mounting plate 69.

The rear keeping plate 69A has a backward bent contact plate 74 which is positioned adjacent to the sub plate 53, as shown in FIG. 9, at the interior side portion thereof. The contact plate 74 is overlapped onto the striker passage 63 in the back-and-forth direction. When a strong external force to be caused by a vehicle accident or the like is applied on the engaged part of the latch 54 and the striker 58, the contact plate 74 comes into contact with the sub plate 53 and keeps the preferable positions of the latch 54 and the pawl lever 29. The contact plate 74 and the sub plate 53 can be fixed to each other by fixing means such as welding, screwing, or hook engaging.

The striker guide 60 does not come into direct contact with the latch and pawl shafts 56 and 57, and is substantially arranged between the shafts 56 and 57. Therefore, the striker guide 60 is extremely small and light, and can be manufactured at a low cost, when compared with a conventional synthetic resin latch body.

The second space 9 where a plurality of operating members such as the lock mechanism 8 are contained is arranged on the interior side with respect to the latch shaft 56, as shown in FIG. 1.

In FIGS. 3 and 4, on the inside of the sub case 3, a cancel lever 75 is supported by the guide shaft 27. The cancel lever 75 has a bent part 76 which is engageably with the pawl pin 30, and a pressing piece 77 which is engageably with the side of the open link 23. When the door is closed in the locked state, the pawl pin 30 is moved upward to rotate the cancel lever 75 clockwise, and the pressing piece 77 then comes into contact with the open link 23 to rotate the open link clockwise, and consequently, the lock lever 21 is restored from the locked position to the unlocked position.

What is claimed is:

1. A vehicle door latch device comprising:

a metal base plate including a main plate in a left-and-right direction and a sub plate in a back-and-forth direction orthogonal to the left-and-right direction, said sub plate being bent backward from an interior side portion of the main plate and having a striker gate in the back-and-forth direction into which a striker fixed to a vehicle body enters, said main plate having a lateral U-shaped striker channel which is communicated with the striker gate;

a latch engageable with the striker;

a pawl lever keeping engagement between the latch and the striker by being engaged with the latch;

a synthetic resin striker guide arranged on a rear side of the main plate and having a striker passage with the same shape as the striker channel;

said latch being arranged between the striker guide and the main plate;

a metal mounting plate having a rear keeping plate which comes into contact with a rear surface of the striker guide;

a latch shaft laid between the main plate and the mounting plate for rotatably supporting the latch; and a pawl shaft laid between the main plate and the mounting plate for rotatably supporting the pawl lever;

wherein said metal mounting plate has a contact plate which is bent backward from an interior side portion of the rear keeping plate, said contact plate being overlapped onto the striker passage in the back-and-forth direction and being positioned adjacent to the sub plate;

wherein said mounting plate has a plurality of forward bent legs which are inserted into a plurality of engaging holes of the striker guide.

2. The vehicle door latch device according to claim 1, wherein said striker guide has an upper wall and a lower wall for dividing the striker passage; and wherein said metal mounting plate has an upper keeping plate which is bent forward from an upper edge of the rear keeping plate for protecting an upper surface of the upper wall, and a lower keeping plate which is bent forward from a lower edge of the rear keeping plate for protecting an under surface of the lower wall.

3. A vehicle door latch device comprising:

a metal base plate including a main plate in a left-and-right direction and a sub plate in a back-and-forth direction, said sub plate being bent backward from an interior side portion of the main plate and having a striker gate in the back-and-forth direction into which a striker fixed to a vehicle body enters, said main plate having a lateral U-shaped striker channel which is communicated with the striker gate;

a latch engageable with the striker;

a pawl lever keeping engagement between the latch and the striker by being engaged with the latch;

a synthetic resin striker guide arranged on a rear side of the main plate and dividing a striker passage with the same shape as the striker channel;

said latch being arranged between the striker guide and the main plate;

a metal mounting plate having a rear keeping plate which comes into contact with a rear surface of the striker guide;

a latch shaft laid between the main plate and the mounting plate for rotatably supporting the latch, said latch shaft being positioned above or below the striker channel; and a pawl shaft laid between the main plate and the mounting plate for rotatably supporting the pawl lever, said pawl shaft being positioned below or above the striker channel;

wherein said striker guide is positioned between the latch shaft and the pawl shaft and comes into no direct contact with the latch shaft and the pawl shaft; and said mounting plate has a plurality of forward bent legs which are inserted into a plurality of engaging holes of the striker guide.

4. The vehicle door latch device according to claim 3, wherein said striker guide has an upper wall and a lower wall for dividing the striker passage; and wherein said metal mounting plate has an upper keeping plate which is bent forward from an upper edge of the rear keeping plate for protecting an upper surface of the upper wall, and a lower keeping plate which is bent forward from a lower edge of the rear keeping plate for protecting an under surface of the lower wall.

* * * * *